US006796549B1

(12) United States Patent
Lester

(10) Patent No.: US 6,796,549 B1
(45) Date of Patent: Sep. 28, 2004

(54) FENCE STRUCTURE

(76) Inventor: Richard F. Lester, 720 SE. 9th Pl., Gainesville, FL (US) 32601

( * ) Notice: Subject to any disclaimer, the term of this patent is extended or adjusted under 35 U.S.C. 154(b) by 139 days.

(21) Appl. No.: 10/096,034

(22) Filed: Mar. 13, 2002

(51) Int. Cl.[7] ..... E04H 17/16

(52) U.S. Cl. ..... 256/59; 256/22; 256/24; 256/27

(58) Field of Search ..... 256/59, 22, 24, 256/27; D25/38

(56) References Cited

U.S. PATENT DOCUMENTS 4,451,025 A 5/1984 Spera
4,805,879 A 2/1989 Spera
5,255,897 A 10/1993 Pepper
5,660,378 A 8/1997 Schall
5,788,224 A 8/1998 Platt
5,795,503 A 8/1998 Krake
6,041,486 A 3/2000 Forbis
6,053,481 A 4/2000 Scheide

*Primary Examiner*—Daniel P. Stodola
*Assistant Examiner*—Ernesto Garcia
(74) *Attorney, Agent, or Firm*—Alvin S. Blum

(57) ABSTRACT

A fence is constructed of fence sections with at least two parallel horizontal rails and vertical pickets attached to the rails. These sections may be preassembled. They are held at their ends in connectors fastened to vertical posts. Rails have unique sectional profiles for enhanced rigidity for spanning greater distances between posts. Rail profile is a channel with open bottom, a flat top web, and a pair of legs extending down from the top web. An additional web extends down one side and joins one of the legs to provide extra rigidity. Apertures in the top web corresponding to the shape of the pickets receive the pickets therethrough. Pickets are fastened to the rails by features which enable the rails to assume an angle other than 90 degrees for securing between post that are not at the same elevation, or "racking".

7 Claims, 3 Drawing Sheets

14
16
17
2
18
19
21
22
23

FENCE STRUCTURE

This invention relates to fences, and more particularly, to picket fences with rails.

BACKGROUND OF THE INVENTION

Fences of the prior art have been made of metal and plastic with extruded top and bottom rails, attached to vertical posts by brackets as exemplified by U.S. Pat. No. 5,255,897 issued Oct. 26, 1993 to Pepper. They generally require supporting posts spaced apart no more than six feet to avoid sagging of the rails. Vertical pickets between top and bottom rails that extend above the top rail generally pass through an enlarged hole in the top rail to permit the fence section to rack between posts, i.e. to assume an angle to the horizontal where the ground is not level. This creates an unattractive structure. It would be useful to have a fence section that could extend as much as eight feet between posts without sagging, and that would not have oversize holes in the top rail to accommodate racking.

SUMMARY OF THE INVENTION

It is accordingly an object of the invention to provide a fence structure that can readily span as much as eight feet between posts because of an improved rail construction. It is another object that the fence rail incorporate an attractive longitudinal feature. It is yet another object to provide improved connection to the posts. It is yet another object to provide improved means for racking. The fence sections comprising parallel rails and pickets may be preassembled and the posts with their connectors provided separately. The vertical posts are then mounted one at a time, one end of the fence section inserted into the connectors on a first post, the other end of the section inserted into the connectors on a second post, and that post fixed in place. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
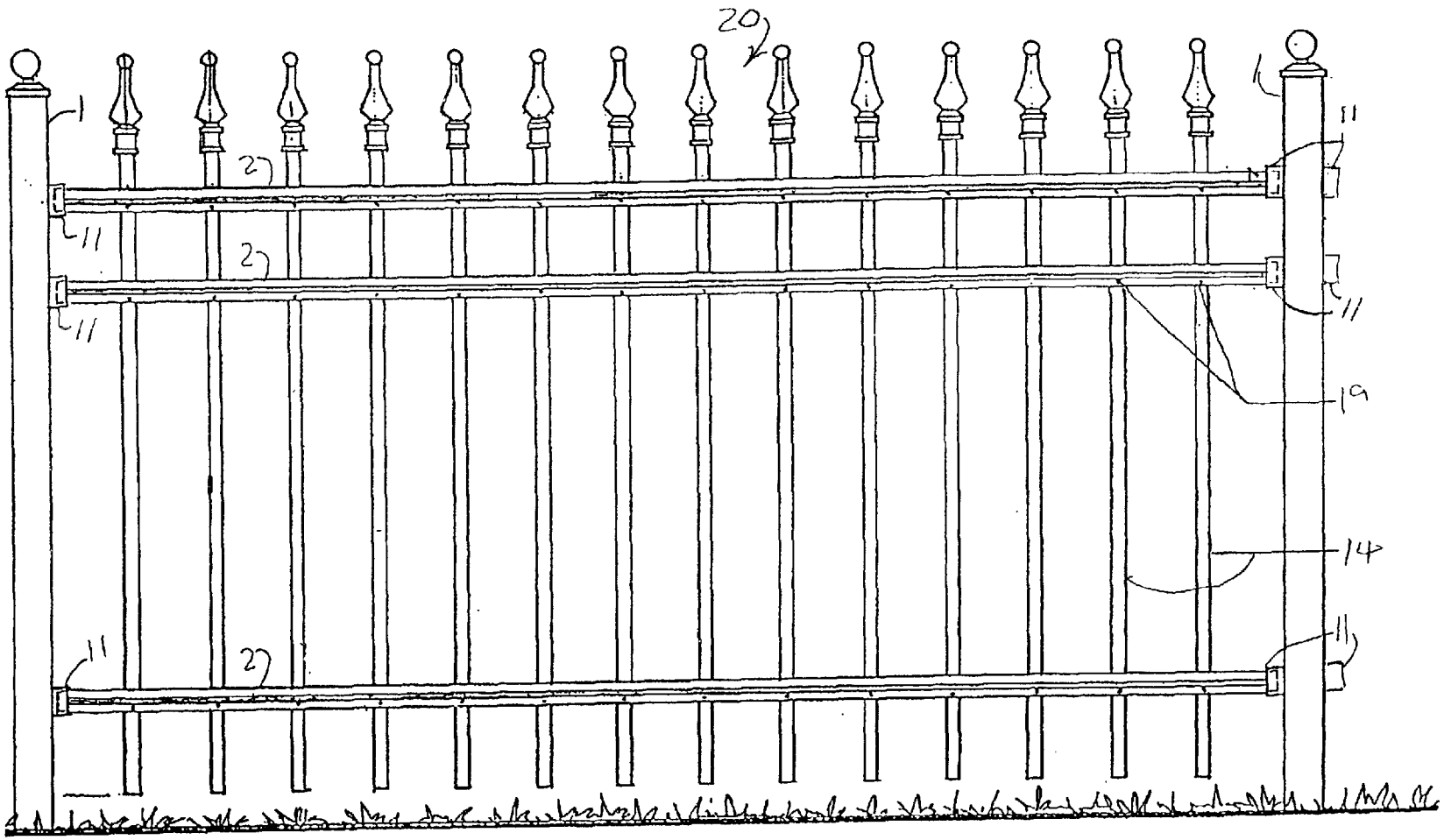
FIG. 1 is a front elevation view of a section of fence of the invention.
Figure 4:
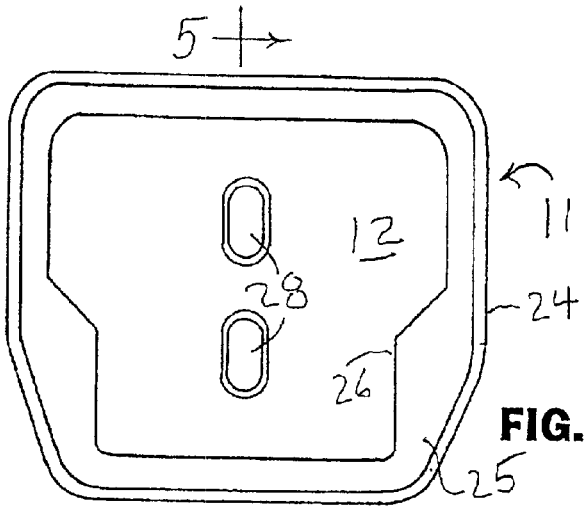
FIG. 4 is a front elevation view of the connector.
Figure 3:
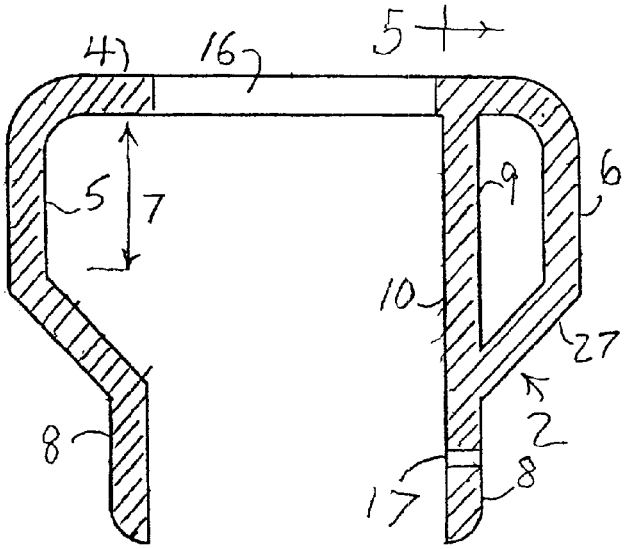
FIG. 3 is a cross sectional view of a rail of the invention.
Figure 5:
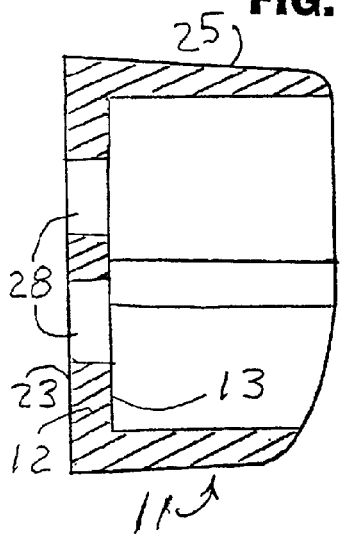
FIG. 5 is a sectional view taken on line 5—5 of FIG. 4.
Figure 2:
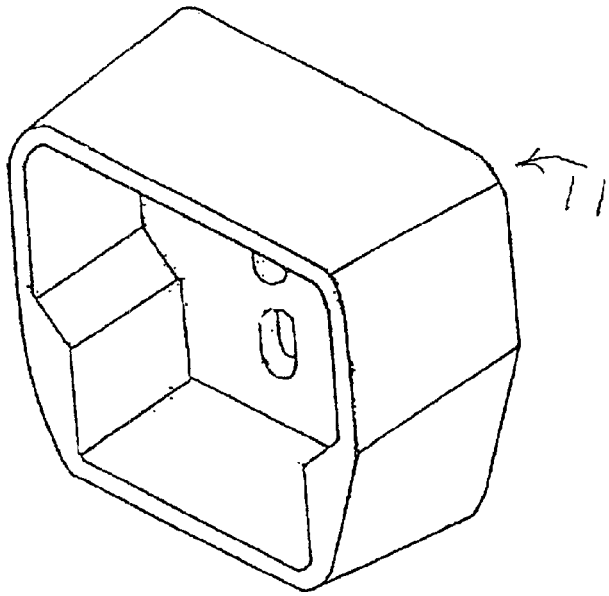
FIG. 2 is a perspective view of a connector of the invention.
Figures 6, 7, 8:
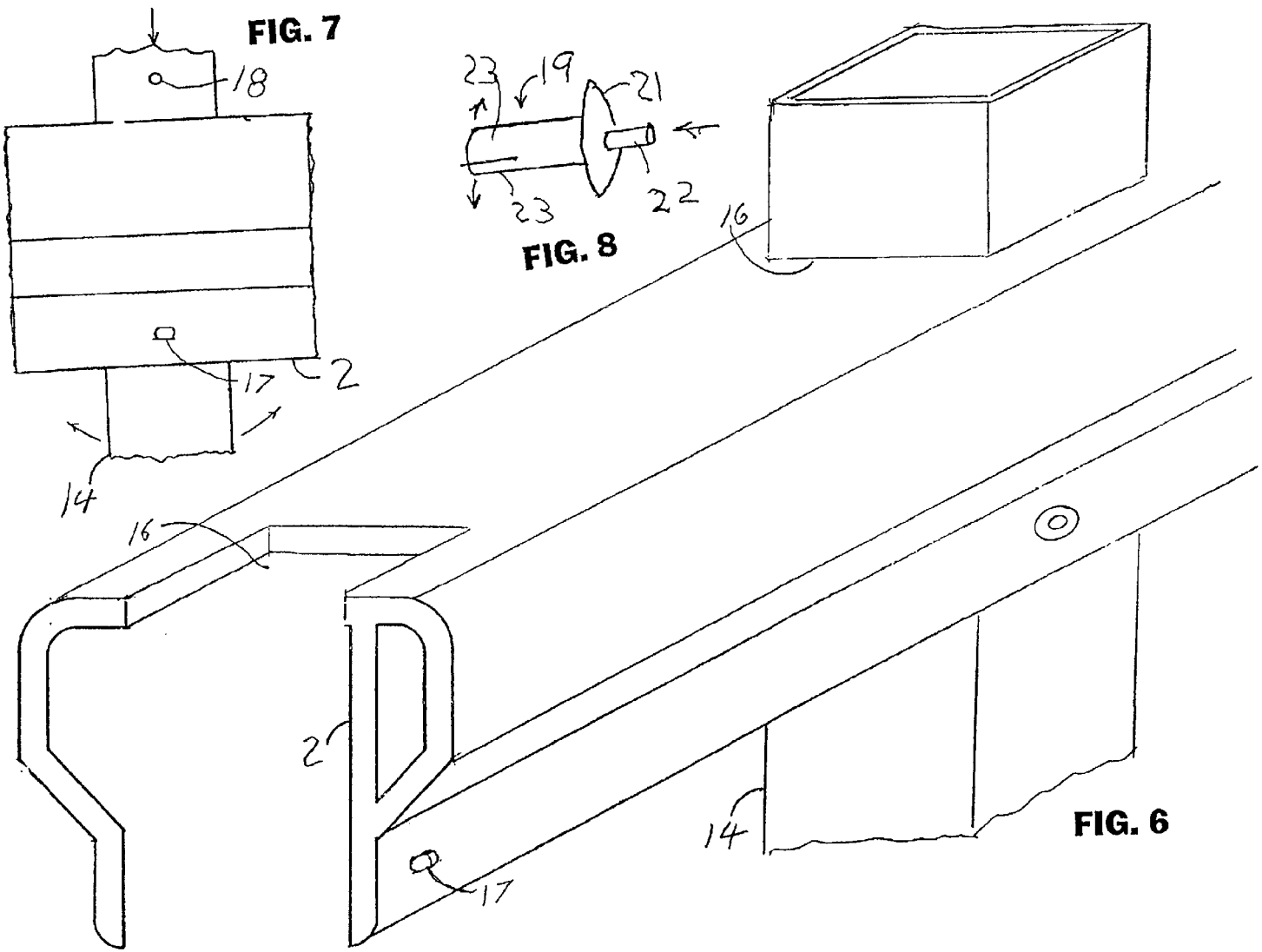
FIG. 6 is a perspective view of a portion of the rail and a picket mounted therein
FIG. 7 is a front elevation detail of a portion of rail and picket being inserted therein.
FIG. 8 is a perspective view of the self-clinching fastener of FIG. 6.

Referring now to FIG. 1, a section 20 of the fence of the invention is shown with vertical posts 1 that may be spaced apart as much as eight feet without sagging of the rails 2. Pickets 14 pass through the parallel rails 2 and are fastened thereto by fasteners 19. A section of fence 1 may be preassembled with two or more parallel rails 2 and the parallel pickets 14 passing through apertures in the rails. Posts 1 are provided separately with connectors 11, into which the ends of the rails fit. When adjacent posts are not supported by a surface with a uniform elevation, then one post will be higher than the other. Provisions are provided for adjusting the fence section so that the rails are parallel, but not orthogonal to the pickets. This enables the ends of the sections to still fit into the connectors. This is termed "racking" in the trade.

Referring now to FIGS. 2–8, the rail 2 has the profile of a channel open at the bottom. The channel has a generally flat top web 4, and a pair of spaced-apart legs 5,6 extending downwardly from web 4 a first distance 7 and then disposed closer together and parallel to one another for a terminal portion 8. A vertical web 9 extends between top web 4 and the terminal portion 8 of one leg 6, thereby providing a planar face 110 extending from the top web 4 to the bottom of the leg. This structure provides great rigidity to the rail, enabling it to span an eight foot space without sagging. Apertures 16 in the top web 4 of the rail conform to the cross section outer contour of the pickets 14, with enough clearance to permit the picket to slide through. The pickets may have a variety of contours, such as round, rectangular, square, etc. as desired, with the aperture 16 shaped to correspond. The picket is passed through the rails until the round holes 18 in the picket are aligned with the holes 17 in the lower portions 8 of one of the legs of the rails. The hole 17 is wider than it is high, for which we use the term "oval". The picket and rail are joined together by self-clinching fasteners 19 passing through the holes 17 and 18. The head 21 of fastener 19 is large enough to cover hole 17. The masonry pingrip covered by GSA specification FF-S-325 has been found to be satisfactory. The fastener is passed through the holes and then the center pin 22 is struck. This causes end 23 to spread apart, thus clinching the fastener. By making hole 17 wider, the angle between picket and rail may be moved from the usual 90 degrees as the picket pivots about aperture 16, when the fence section must be racked.

Connecting means 11 comprises a base panel 12 having a front surface 13, a rear surface 23, and an outer perimeter 24; and an encircling wall 25 extending outwardly from the front surface at the perimeter thereof. The wall has an inner surface 26 that corresponds in shape substantially to the outer contour 27 of the rail. The wall and panel create a receptacle for loosely receiving therein an end of the rail. The base panel is provided with means for attaching to the post. In this case two oval apertures 28 in the panel receive fasteners for securing the connector to the post, permitting some vertical adjustment. The rear surface 23 may be slightly concave to facilitate flush mounting on the post While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A fence comprising:

a) a pair of spaced-apart, vertical posts;

b) a pair of spaced-apart, generally parallel rails comprising, a top rail and a bottom rail each rail having a profile of a channel with a top web and a pair of spaced-apart legs extending downwardly from the web a first distance and then disposed closer together and spaced apart and parallel to one another for a terminal portion, and a vertical web extending between the top web and a terminal portion of one of the legs, so as to provide a planar inner face extending from the top web to the bottom of one of the legs;

c) connecting means for connecting a first end of each rail to a first of the posts and a second end of each rail to a second of the posts;

d) a plurality of pickets having a particular transverse cross section, the pickets arranged spaced-apart and parallel to one another between the top and bottom rails;

e) an aperture in the top web of the rails corresponding to the transverse cross section of the pickets for each picket, through which the picket passes;

f) an oval hole in the terminal portion of one of the legs directly below the aperture; and g) a hole in the picket aligned with the oval hole for receiving a first fastener therethrough, whereby the oval hole provides means for positioning the rail at an angle that is not ninety degrees to the picket.

2. The fence according to claim 1, in which the connecting means comprises:

a) a base panel having a front surface, a rear surface and an outer perimeter, b) an encircling wall extending outwardly from the front surface at the perimeter thereof, the wall having an inner surface that corresponds substantially in shape to the outer contour of the profile of the rail, the wall forming a receptacle adapted for receiving therein an end of the rail; and c) attachment means for attaching the connecting means to one of the posts with the rear surface of the base panel flush against the post.

3. The fence according to claim 2, in which the attachment means includes at least two oval apertures in the base panel for receiving second fasteners therethrough to provide a limited vertical adjustment of the rail.

4. The fence according to claim 2, in which the first fastener is a self-clinching fastener.

5. The fence according to claim 1, in which the first fastener is a drive pin.

6. The fence according to claim 1, in which the first fastener is a self-clinching fastener.

7. A fence rail for supporting a plurality of pickets, the rail having a profile of a channel with a top web and a pair of spaced-apart legs extending downwardly from the web a first distance and then disposed closer together and spaced apart and parallel to one another for a terminal portion, the top web provided with apertures therein corresponding to the transverse cross section of the pickets for each picket, through which the picket may pass, an oval hole positioned directly below each aperture in the terminal portion of one of the legs, and a vertical web extending between the top web and a terminal portion of one of the legs, so as to provide a planar inner face extending from the top web to a bottom of one of the legs.

* * * * *